United States Patent [19]

Oney

[11] Patent Number: 4,999,848

[45] Date of Patent: Mar. 19, 1991

[54] NOVELTY SHIRT

[76] Inventor: Dale E. Oney, 835 Rossini Blvd., Windsor, Ontario, Canada, N8Y 2Z2

[21] Appl. No.: 512,488

[22] Filed: Apr. 23, 1990

[30] Foreign Application Priority Data

Sep. 22, 1989 [CA] Canada ..... 612493

[51] Int. Cl.[5] ..... A41B 1/00; A41D 27/08

[52] U.S. Cl. ..... 2/115; 2/246; 40/586

[58] Field of Search ..... 2/115, 246, 94; 40/586

[56] References Cited

U.S. PATENT DOCUMENTS

| | | | |
|---|---|---|---|
| 2,647,261 | 8/1953 | Rassner | 2/246 |
| 4,078,265 | 3/1978 | Condit | 2/115 |
| 4,277,848 | 7/1981 | Boehland | 2/115 |
| 4,296,498 | 10/1981 | Vinson | 2/115 |
| 4,710,981 | 12/1987 | Sanchez | 2/115 |
| 4,875,237 | 10/1989 | Cohen | 2/115 |

FOREIGN PATENT DOCUMENTS

| | | | |
|---|---|---|---|
| 1231501 | 1/1988 | Canada | 2/46 |

*Primary Examiner*—Werner H. Schroeder

*Assistant Examiner*—Gloria Hale

*Attorney, Agent, or Firm*—Michael Sand Co.

[57] ABSTRACT

A garment, such as shirt, having a piece of material which may be of the same material as the shirt fastened along an upper edge to the front panel of the shirt so as to form a flap which normally hangs from about a mid-portion of the front panel. The fastening line provides a horizontal hinge line, and when hanging in the normal position, the flap covers the outer surface of the lower portion of the front panel of the shirt. The outer surface of the flap together with the outer surface of the front panel of the shirt above the hinge line form a first display area. When the flap is held in a raised position, the inside surface of the flap together with the outer surface of the lower surface of the front panel form a second display area. A first part of a message or information is presented on the first display area and a sequel part of the message or information is provided on the second display area. Thus, the garment forms a novelty shirt in that after a person sees the first message, while the second message remains hidden, the wearer or the other person may lift the flap to a raised position to let the person see the second part of the message.

12 Claims, 1 Drawing Sheet

NOVELTY SHIRT

BACKGROUND OF THE INVENTION

1. Field of the Invention

The present invention relates to a garment, and more particularly to a novelty shirt structured to display different messages or information.

A high percentage of shirts commonly called sweat shirts and T-shirts now sold are provided with printed pictures, slogans, cartoons, advertisements, etc. The popularity of such shirts is no doubt due to various physiological reasons, such as attracting attention to the wearer, to provide humour for ones associates, or to provide a topic for opening a conversation with others. It is apparent, however, that the more bizarre the presentation, the more curiosity it can stimulate, or the stronger the message transmitted, the more successful the wearer feels the shirt is.

2. Description of the Prior Art

Generally the pictures or written material appear in the chest area, or occasionally on the back, and possibly both. U.S. Pat. No. 4,710,981, issued Dec. 8, 1987, to David J. Sanchez, and entitled "Interactive Message Garment" shows a shirt having a strip of material folded on itself to form a front panel of a pocket, the front panel being normally secured to a inner panel by a gripping surface so that it can be pulled open and swung about a vertical hinge line to reveal a message applied to the inner panel. The structure shown in this U.S. patent is designed mainly for use by sports fans and is structured and positioned on the front of the shirt for opening by the shirt wearer so as to express his opinion on an aspect of the game he is watching.

SUMMARY OF THE INVENTION

It is the object of the present invention to provide a novelty garment designed to attract interest and to produce a greater effect by showing alternatively different displays of information or expressions, and also to allow others to actively participate in the action of changing the display.

Accordingly to the present invention there is provided a novelty garment including front and rear panels for covering the chest and upper back portion of the human torso, the panels being joined and defining a waist opening, a neck opening and sleeve openings. The garment has flap means joined to at least one of the panels along a horizontal hinge line and hanging freely therefrom and covering an outer surface of a lower portion of the one panel. The flap means has an outside surface visible and together with an outer surface of an upper portion of the one panel above the hinge line forms a first display area when the flap means is in the freely hanging position. The flap means also has an inside surface disposed adjacent to the lower portion of the one panel below the hinge line when the flap means is in the freely hanging position and together with the outer surface of the lower portion forms a second display area visible only when the flap means is raised about the hinge line to a held position. First information is provided on the first display area, and second information sequel to the first information appears on the second display area.

The first information which is visible when the flap is hanging in a normal position may be, for example, the first part of a proposition or the question portion of a joke or riddle. The second information preferably follows the first information, such as the answer to the joke or riddle, and it is not visible, of course, to others unless the flap is raised and held above the hinge line. Thus the wearer can flash the second information when another has been attracted to the first information, or the other person may raise the flap out of curiosity.

BRIEF DESCRIPTION OF THE DRAWINGS

In the accompanying drawings, which show an embodiment of the invention as an example.

DESCRIPTION OF THE PREFERRED EMBODIMENTS

Figure 1:
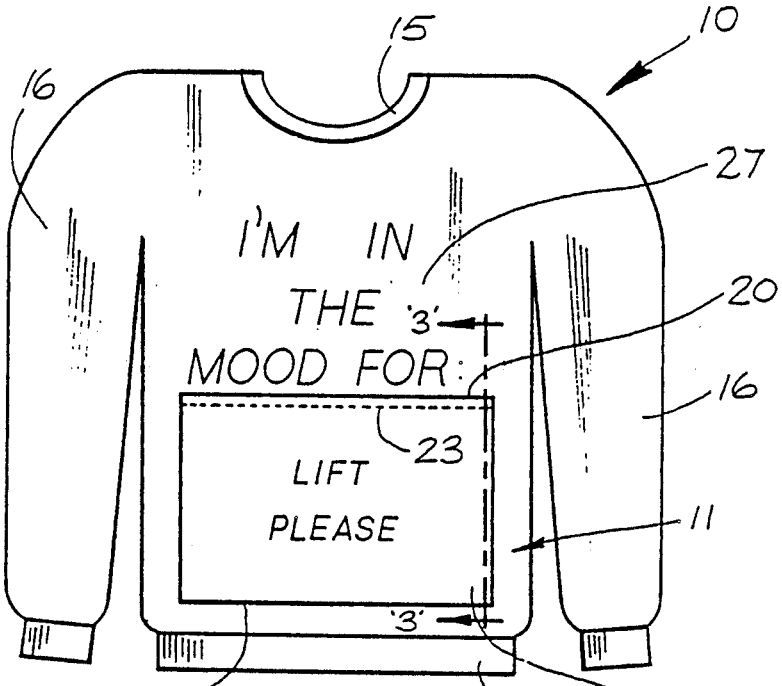
FIG. 1 is a front view of a garment in the form of a sweat shirt with the flap means hanging in a normal position.

In the drawings, the reference character 10 generally denotes a garment in the form of a shirt having a flap means 11 on the front thereof. It will become apparent that the flap means may be provided on the back of the shirt, or alternatively, separate flap means could be provided on the back and front of the same shirt. However, for the sake of simplicity, the illustrated embodiment shows the flap means only on the front which is believed to be the most preferred arrangement.

The garment includes front and rear panels 12 and 13, respectively, formed of a cloth material which may be of the woven or non-woven type. The panels are joined to form an enclosure with normal waist opening and neck opening provided with the conventional waist band 14 and collar band 15. The panels 12 and 13 also have sleeve openings to which are seamed sleeves 16 in the illustrated embodiment.

The flap means 11 is in the form of a separate piece of material 17, which may be rectangular in shape, having an upper edge 20, a lower edge 21 parallel to the upper edge, and side edges 22. The piece of material is preferable of the same material as the front and rear panels of the shirt, or alternatively, it may be of different material and even of different colour, if it is desirable, for example, to make the flap means more conspicuous. The piece of material 17 is secured along a line immediately adjacent to its upper edge 20 to the exterior of the front panel, the line being horizontal and in effect providing a hinge line for the flap means. The means of attachment of the upper edge of the piece 17 to the front panel is shown as a stitching 23, although it is apparent a fusing process could be used, particularly if the front panel 12 and the piece 17 are both formed of well known non-woven synthetic materials now used in shirts. The hinge line formed by the stitching 23 is at approximately the mid portion of the front panel 12 of the shirt, and the size of the piece of material forming the flap means is selected so that its length is sufficient to have the flap means extending across most of the width of the front of the torso of the wearer. The width of the piece, i.e., the length of the side edges 22, is such that the bottom edge is close to the bottom of the front panel when the flap means is hanging in its normal position. The corners of the piece 17, and particularly the two bottom corners may be rounded for aesthetic purposes. When raised, the flap means covers a major portion of the chest area above the hinge line.

Figure 2:
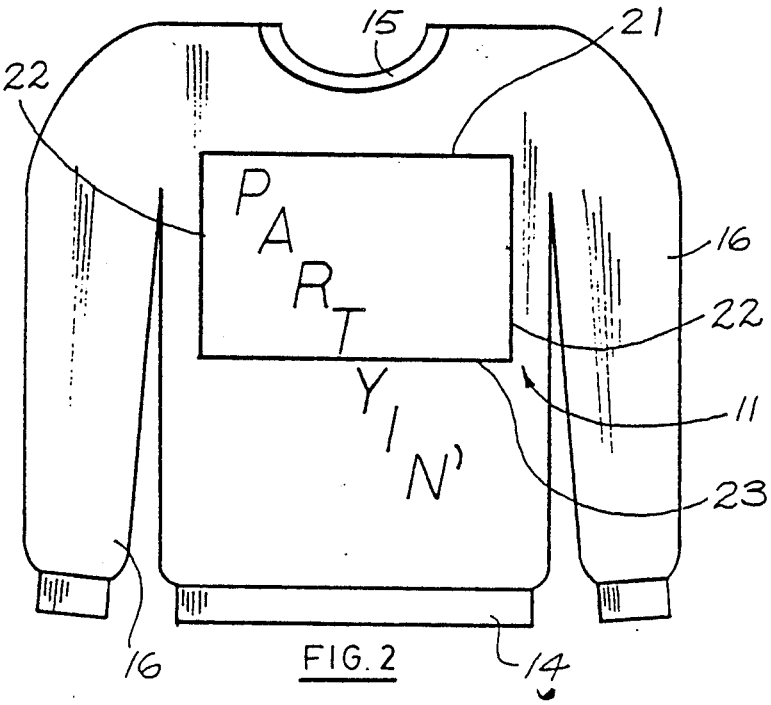
FIG. 2 is a view similar to FIG. 1, but showing the flap means in a raised position.
Figure 3:
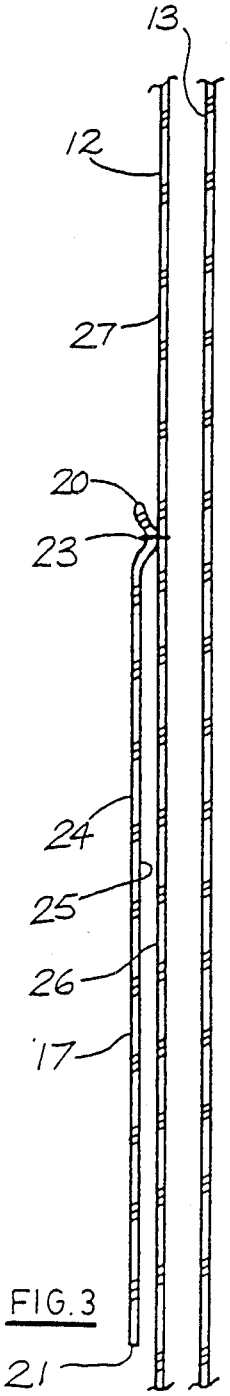
FIG. 3 is a sectional view as seen from line 3—3 of FIG. 1.

An outside surface 24 of the piece of material forming the flap means, i.e, the surface area between the upper and lower edges 20 and 21, is visible when the flap means is hanging in its normal position. In this position an inside surface 25, hangs immediately in front of the outside surface 26 of the lower portion of the front panel 12. The outside surface 24 together with the outside surface 27 of the front panel above the hinge line of the flap means 11 provides a first display area which can basically occupy the entire area forming the front of the garment and is entirely visible when the flap means is hanging freely in its normal position (FIG. 1). The inside surface 25 and the outside surface 26 of the front panel below the hinge line provide a second display area when the flap means is grasped and held in a raised position (FIG. 2). The second display area thus occupies alternatively the same general area at the front of the garment when the flap means is raised by the wearer or someone else curious to see the information concealed by the flap means under normal conditions.

As shown as an example in the drawings, first information in the form of "I'M IN THE MOOD FOR" is applied to the first display area. Second information, which is preferably sequel to the first information, and in the present example, "PARTYIN'", occupies the second display area. In the example, the above described first information could occupy the whole first display area, rather than just that portion provided by the surface 27, but as shown, the area provided by the outside surface 24 of the piece 17 has been reserved for the invitation "LIFT PLEASE". Similarly, the second information could occupy only the area provided by the surface 26 or alteratively by the surface 25, depending on the effect desired.

In this specification, the term "information" has been used for convenience, but it is apparent that this is meant to include all types of expressions, pictures, slogans, jokes, etc. Although only one example has been shown various modifications within the spirit of the invention as defined in the appending claim will be obvious to those skilled in the art.

I claim:

1. A novelty garment comprising front and rear panels for covering the chest and upper back portion of the human torso, said panels being joined and defining a waist opening, a neck opening and sleeve openings, and flap means including a separate piece of material having an upper edge joined to one of said panels by a seam forming a horizontal hinge line along a substantially mid-portion of said one panel, said flap means hanging freely from said horizontal hinge line, said piece of material being sized to cover a major portion of an outer surface of a lower portion of said one panel below the hinge line, said flap means having an outside surface visible and together with an outer surface of an upper portion of said one panel above said hinge line forming a first display area when said flap means is in a freely hanging position, said piece of material being sized to cover a major portion of said outer surface of upper portion of the front panel above the hinge line when said flap is raised about the hinge line to a held position, said flap means having an inside surface disposed adjacent to said outer surface of the lower portion of said one panel below said hinge line when said flap means is in said freely hanging position and together with said outer surface of said lower portion forming a second display area visible only when said flap means is raised about said hinge line to a held position, first information applied to said first display area, and second information sequel to said first information applied to said second display area.

2. A garment as defined in claim 1, wherein said panels and said separate piece of material are formed of the same material.

3. A garment as defined in claim 1, wherein said seam is a stitching through said piece of material and said one panel.

4. A garment as defined in claim 1, wherein said seam is formed by fusing said piece of material to said one panel along said hinge line.

5. A garment as defined in claim 1, wherein said one panel forms the front panel of a shirt.

6. A garment as defined in claim 5, wherein said piece of material is substantially rectangular, said outside being defined by the outer surface of said piece between said upper edge and a lower substantially parallel edge.

7. A garment as defined in claim 1, wherein said information of said first display area occupies a major part of said first display area.

8. A garment as defined in claim 1, wherein said information in said first display area appears only on said surface of said front panel above said hinge line.

9. A garment as defined in claim 8, wherein instruction information appears in said first display area on the outside surface of said flap means.

10. A garment as defined in claim 1, wherein said information of said second display area occupies substantially all of said second display area.

11. A garment as defined in claim 10, wherein said information of said second display area occupies only the inside surface of said flap means.

12. A garment as defined in claim 10, wherein said information of said second display area occupies only said outer surface of said lower portion of said front panel.

* * * * *